US009711902B2

(12) United States Patent
Kot et al.

(10) Patent No.: US 9,711,902 B2
(45) Date of Patent: Jul. 18, 2017

(54) ELECTRICAL PLUG CONNECTOR FOR A SAFETY RESTRAINT SYSTEM

(71) Applicant: DELPHI TECHNOLOGIES, INC., Troy, MI (US)

(72) Inventors: Lukasz Kot, Suloszowa (PL); Bartlomiej Siwek, Krakow (PL); Peter Nuetzel, Oberasbach (DE); Michael Gunreben, Schwanstetten (DE); Vincent Regnier, Spardorf (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/202,724

(22) Filed: Jul. 6, 2016

(65) Prior Publication Data

US 2017/0012392 A1 Jan. 12, 2017

(30) Foreign Application Priority Data

Jul. 8, 2015 (EP) ..... 15175867

(51) Int. Cl.
*H01R 29/00* (2006.01)
*H01R 13/64* (2006.01)
(Continued)

(52) U.S. Cl.
CPC ..... *H01R 13/64* (2013.01); *H01R 13/03* (2013.01); *H01R 13/631* (2013.01);
(Continued)

(58) Field of Classification Search
CPC ..... H01R 43/18; H01R 13/64; H01R 13/03; H01R 13/633
(Continued)

(56) References Cited

U.S. PATENT DOCUMENTS 5,277,607 A 1/1994 Thumma et al.
5,591,041 A * 1/1997 Cecil, Jr. ..... H01R 13/506 439/352
(Continued)

FOREIGN PATENT DOCUMENTS

GB 1331825 A 9/1973
JP S5328290 A 3/1978
(Continued)

*Primary Examiner* — Abdullah Riyami
*Assistant Examiner* — Nader Alhawamdeh
(74) *Attorney, Agent, or Firm* — Robert J. Myers

(57) ABSTRACT

The invention relates to an electrical plug connector for a safety restraint system, preferably for an airbag ignition system, including at least two contact terminals disposed within the plug connector and a shorting clip, that is configured to short circuit the at least two contact terminals in an uncoupled or incorrectly coupled condition of the plug connector. The shorting clip includes at least two shorting tongues. Each shorting tongue is electrically connected with a respective contact terminal. Each shorting tongue further includes at least one electrical contact surface and at least one of the shorting tongues includes an actuating member. The actuating member is provided with an actuating surface that is configured to interact with a separator device. The contact surfaces are not arranged within the same plane as the actuating surface(s).

15 Claims, 9 Drawing Sheets

(51) Int. Cl.

| | |
|---|---|
| ***H01R 13/641*** | (2006.01) |
| ***H01R 13/703*** | (2006.01) |
| ***H01R 13/03*** | (2006.01) |
| ***H01R 13/631*** | (2006.01) |
| ***H01R 13/633*** | (2006.01) |
| ***H01R 43/18*** | (2006.01) |
| ***H01R 43/26*** | (2006.01) |

(52) U.S. Cl.
CPC ..... *H01R 13/633* (2013.01); *H01R 13/641* (2013.01); *H01R 13/7033* (2013.01); *H01R 13/7034* (2013.01); *H01R 43/18* (2013.01); *H01R 43/26* (2013.01)

(58) Field of Classification Search
USPC ..... 439/188
See application file for complete search history.

(56) References Cited

U.S. PATENT DOCUMENTS 6,893,277 B2 * 5/2005 Parrish ..... H01R 13/506 439/188
8,545,262 B2 * 10/2013 Schmidt ..... H01R 13/7032 439/188
9,054,457 B2 * 6/2015 Odorfer ..... F42B 3/26
2002/0081888 A1 * 6/2002 Regnier ..... H01R 13/639 439/352
2002/0115336 A1 * 8/2002 Gunreben ..... H01R 13/5829 439/468
2004/0248454 A1 * 12/2004 Gunreben ..... H01R 13/639 439/352
2007/0082524 A1 4/2007 Barthes et al.
2007/0105442 A1 * 5/2007 Gunreben ..... H01R 13/447 439/607.01
2012/0112762 A1 * 5/2012 Odorfer ..... F42B 3/26 324/538
2013/0252455 A1 * 9/2013 Gunreben ..... H01R 13/6277 439/370
2014/0045361 A1 * 2/2014 Gunreben ..... H01R 13/6273 439/345
2014/0287611 A1 * 9/2014 Gunreben ..... H01R 13/6273 439/354

FOREIGN PATENT DOCUMENTS

WO 2004020933 A1 3/2004
WO 2010143078 A2 12/2010
WO 2011058189 A1 5/2011

* cited by examiner

ELECTRICAL PLUG CONNECTOR FOR A SAFETY RESTRAINT SYSTEM

CROSS-REFERENCE TO RELATED APPLICATION

This application claims the benefit under 35 U.S.C. §119 (a) of Patent Application No. 15175867.9 filed in the European Patent Office (EPO) on Jul. 8, 2015, the entire disclosure of which is hereby incorporated by reference.

TECHNICAL FIELD OF THE INVENTION

The invention relates to an electrical plug connector for a safety restraint system, preferably for an airbag ignition system and in particular to plug connectors including at least two terminals, with which it is possible to electrically or electronically monitor the correct coupling of the plug connector with a suitable counter-connector.

BACKGROUND OF THE INVENTION

Passenger cars have a number of safety restraint systems, such as seat belt pre-tensioners or airbags which serve to cushion or limit the impact of a passenger with for example interior parts of passenger cars in case of an accident. Deceleration sensors in the passenger vehicle detect high deceleration values as they occur in case of an accident and send a trigger signal via wire or cable to the safety restraints system. An explosive device, known as squib, inflates the airbag or tightens the belt. The wires or cables of the deceleration sensor are connected to an electronic controlled unit and then to a squib, by means of a so called squib connector.

The squib is usually provided with a socket or receptacle which contains two contact pins. The squib connector includes a plug part or a plug connector corresponding to the socket, which plug part has two receptacles for the reception of the contact pins of the squib socket. To improve the connection between the squib and the plug connector, retainer inserts were developed, which are configured to fit into the receptacle of standardized squibs and which facilitate and secure the connection between the squib and the plug connector. Further, connector position assurance members better known as CPA members were developed, that are mated with the plug connector after the plug connector is coupled to a corresponding counter-connector. Such a CPA member is designed, so that a mating of the CPA to the plug connector is only possible when the plug connector is correctly coupled to the corresponding counter-connector, i.e. the CPA member cannot be mated to the plug connector when the plug connector is in an uncoupled or incorrectly coupled condition.

The principle structure of an (airbag) squib is for example described in document WO 2004/020933. The squib described in this document includes an outer can enclosing a suitable pyrotechnic charge and an ignitor which is provided with two contact pins being electrically connected to an ignitor wire which can activate the charge of the squib. The ignitor further encloses a retainer for securing the squib to the housing of e.g. an airbag inflator, which retainer further includes a plastic insert, which is injection molded around the pins of the squib and which serves to provide for mechanical fastening with the corresponding (squib) plug connector. The retainer is further provided with a so called shorting clip, which is usually an electro conductive metallic spring part, which in the non-coupled condition electrically connects the two pins of the squib with each other, i.e. shorting the same.

The shorting of the contact pins serves to prevent an unintended explosion of the pyrotechnic charge due to electrical potential differences occurring between the two contact pins, for example during transport or handling. The shorting circuit established by the shorting clip is separated and opens upon correct coupling of the corresponding plug connector into or with the retainer, respectively the corresponding counter-connector. Alternatively, the shorting clip can be opened by a CPA member. Usually a contact pin member of a shorting clip is displaced by a plug part of the plug connector so that the two contact pins are no longer electrically connected. These shorting clips of the prior art are not only intended to prevent an unintentional ignition of the charge of the squib, but they also serve as a control or monitoring device of the correct coupling of the (squib) plug connector with its counterpart, i.e. the squib receptacle respectively the retainer or insert mounted therein. Upon correct coupling of the plug connector with its counterpart, the short circuit between the contact pins of the squib is automatically opened as described above, and this can be detected by means of suitable electrical/electronic monitoring device, as it is well known to the skilled person.

Modern squibs are so reliable that a shorting clip is no longer absolutely necessary. Thanks to these improvements, an unintended ignition of the charge due to an electrical potential difference between the contact pins can be ruled out. Thus, for this new type of squib, the shorting clips could be disposed of, thereby reducing the manufacturing costs for the squib connectors considerably. However, the shorting clip is not only a safety feature for an unintended ignition of explosive charge of the airbag or belt pretension system but it is also commonly used to monitor the correct coupling of the plug connector with its counterpart. Without a shorting clip, this is no longer possible with the existing connector systems.

Document WO 2010/143 078 discloses a squib connector that allows the electrical monitoring of the correct coupling of the plug connector. Therefore, the terminals of the connector are in electrical contact with each other in the uncoupled or incorrectly coupled condition of the plug connector. This electrical contact between the terminals is configured for being separated upon correct coupling to a corresponding counter-connector either automatically, i.e. by a retainer or by an actuating action, such as a mating CPA member. Thus, disconnecting of the terminals can be monitored by a suitable monitoring device. The electrical contact between the terminals is established by a contact, which are provided with one bendable contact tongue. This bendable tongue is bent out of contact upon correct coupling of the plug connector by e.g. separator device.

The separator device is an electrical insulator and preferably includes plastic. The contact surfaces of the shorting clip provided in the plug connector are typically in contact with the separator device. Due to the contact, of plastic and metallic surface of the shorting clip, the contact surface of the shorting clip can be contaminated with wear debris of the separator device. In particular due to relatively high operation temperatures, the contact surfaces of the shorting clip can be unintentionally coated with residual layers of plastic. This effect is known as fogging. In case of disassembling of the electrical plug connector and anew coupling to a corresponding counter-connector, the monitoring function can be distorted, due to the residual layers, disposed on the contact surfaces of the shorting clip.

An electrical plug connector having a shorting clip is also known from Document WO 2011/058189 A1. The shorting clip of the disclosed plug connector can be separated by a separator device. However, it has been found, that these separator device are beside the drawbacks with regard to residual layers, error prone to unintentional contacting under high vibration levels. Unintentional short circuiting of the terminal of the plug connector is highly disadvantageous, since e.g. the ignition of a charge of a squib might be hindered.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

It is therefore an object of the present invention to provide a connector for a safety restraint system, which allows the electrical or electronic monitoring of the correct coupling of a (squib) plug connector with its corresponding counterpart, like for example a squib receptacle or a retainer insert for a squib receptacle. It is a further object of the invention to provide a connector with such a monitoring function, which is cheaper to produce than the known connectors. Further, it is a direct object of the invention to improve the electrical conductivity of the contact of shorting clip in order to make the monitoring function more reliable.

An electrical plug connector for safety restraint systems, preferably for an airbag ignition system, is provided. The electrical plug connector includes at least two contact terminals disposed within the plug connector and a shorting clip that is configured to short circuit the at least two contact terminals in an uncoupled or incorrectly coupled condition of the plug connector, wherein the shorting clip includes at least two shorting tongues, wherein each shorting tongue is electrically connected with a respective one of the at least two contact terminals and wherein each shorting tongue further includes at least one electrical contact surface, and wherein the electrical contact surfaces contact each other to short circuit the at least two contact terminals when the plug connector is in an uncoupled or incorrectly coupled condition; and wherein at least one of the shorting tongues includes an actuating member, wherein the actuating member is provided with an actuating surface that is configured to interact with a separator device when the plug connector is in a correctly coupled condition, and wherein the contact surfaces are not arranged within the same plane as the actuating surface(s).

The plane of a surface is defined by the surface itself if the surface is e.g. a flat surface. In the case that the surface is a curved surface that is for example achieved by bending or by embossing a metal sheet, the plane that is associated with the curved surface is the tangential surface in the contact point. The contact point has to be understood as the point, in which the shorting tongues contact each other or respectively, the point, in which the separator device contacts the actuating surface.

The contact terminals of the plug connector are configured to be connected with corresponding contact pins of the corresponding counter-connector. The corresponding counter-connector is for example a receptacle of an airbag squib or a retainer associated with the squib. The shorting clip allows the monitoring, in particular an electrical and/or electronic monitoring of the coupling condition of the plug connector. Since the shorting clip includes at least two shorting tongues that are electrically connected with a respective one of the at least two contact terminals and since the contact tongues contact each other to short circuit the at least two contact terminals, the shorting clip has at least two states: In the first state, the short circuit state, the plug connector is in an uncoupled or incorrectly coupled condition. In the second state, the open or separated state, the plug connector is in a correctly coupled condition. The second state can only be achieved upon correct coupling, i.e. the contact between the shorting tongues is separated (opened) only if the plug connector is in a correctly coupled condition. Therefore, preferably the electrical connector or the corresponding counter-connector is provided with a separator device, which separator device separates (opens) the electrical contact between contact surfaces of the shorting tongues upon the correct coupling of the plug connector with the corresponding counter-connector.

These two states, i.e. the short circuit state and the open state can be easily monitored electrical or electronically. It should be noted that the term "electrical or electronic monitoring" as used herein, is intended to describe all kinds of monitoring action which makes use of electrical signals. Further, it should be noted that the term "terminals" as it is used herein, describes all parts associated with terminals which are arranged inside or close to the housing of the plug connector. In other words, also parts of the electrical signal lines are considered as being part of the terminals, as long as they are arranged inside or close to the plug connector housing.

The shorting tongues are electrically connected with a respective one of the at least two contact terminals, so that terminals can be short circuited. The electrical connection can be achieved by integrally forming a shorting tongue and a respective terminal as one part, or by providing an electrically conductive connection therebetween. The electrical contact surface of a shorting tongue can be any surface on the shorting tongue, and is in particular defined as the surface, in which the shorting tongues contact each other in the uncoupled or incorrectly coupled condition of the plug connector. Preferably, the electrical contact surface of a shorting tongue is provided as a specific surface area on the shorting tongue. This specific surface area can for example be achieved by metal forming techniques, such as embossing and/or the like.

The interaction between the actuating member and in particular the actuating surface and a separator device includes a contact between the separator device and the actuating surface. Preferably, said contact leads to a movement and/or a bending of the corresponding shorting tongue, so that the actuating surface is moved/bent and the contact between the shorting tongues is opened. The separator device is an electrical insulator and preferably includes a plastic material. Since the contact surfaces are not arranged within the same plane as the actuating surface(s), a functional separation of the actuating surface and the contact surface is achieved. Particularly, the actuating surface(s) is/are configured to contact the separator device, and the contact surfaces of the shorting tongues are configured to contact each other. Thus, a contact between the contact surfaces and the separator device can be avoided. This will lead to a reduced building of residual layers on the contact surfaces of the shorting tongues. In particular, residual layers resulting from fogging can be avoided. Thus, the electrical resistance of the contact between the contact surfaces is improved, since fogging is hindered. By avoiding a contact between any plastic parts and the contact surfaces, the undesired deposition of plastic (fogging) on the contact surfaces can be avoided and the contact performance of the contact surfaces can be maintained even after numerous plugging and unplugging actions of the plug connector.

Preferably, at least one of the two shorting tongues include a bendable portion, which bendable portion is bent to open the contact of the at least two contact surfaces upon correct coupling of the plug connector. In particular, one bendable portion is sufficient to open the contact between the shorting tongues (i.e. the contact surfaces of the shorting tongues) in order to monitor the correct coupling of the plug connector. The correct coupling of the plug connector occurs when the plug connector is coupled mechanically correct to the corresponding counter-connector. This mechanically correct coupling is achieved by the design of the plug connector and the corresponding counter-connector, i.e. the bendable portion is bent to separate, or open, the contact between the contact surfaces, only if the coupling of the plug connector to the corresponding counter-connector is correctly completed.

Preferably, the electrical plug connector further includes a housing and a connector position assurance (CPA) member, which is insertable into the housing of the plug connector and which CPA member includes a separator device, which separator device interacts with the actuating surface of the actuating member during the insertion of the CPA member into the housing of the plug connector, so that the electrical contact between the at least two contact surfaces is opened. The CPA member typically can only be inserted when the plug connector and the corresponding counter-connector are coupled correctly. Thus when the CPA member is fully insertable into the housing of the plug connector, the plug connector is correctly coupled to the corresponding counter-connector and the electrical contact between the contact surfaces is separated (opened). Therefore, the coupling condition of the electrical connector can be monitored.

Preferably, the electrical contact between the at least two contact surfaces is configured to be opened upon correct coupling the electrical plug connector to a corresponding counter-connector, wherein the corresponding counter-connector includes a separator device, which separator device interacts with the actuating surface of the actuating member during correct coupling of the plug connector to the corresponding counter-connector so that the electrical contact between the at least two contact surfaces is opened. Typically, the separator device is forced between the two shorting tongues, so that the contact between the contact surfaces is opened. Since specific actuating surfaces are provided, the separator device does not contact the contact surfaces, so that the deposition of residual layers (e.g. fogging) can be significantly reduced. The separation of the contact between the contact surfaces can be achieved either automatically or by an actuating action. An automatic separation of the contact surfaces is preferably achieved by a part of the counter-connector, which separates the contact upon full insertion of the plug connector. Alternatively, it is also possible that a manual or automated actuating action is necessary to disconnect the electrical contact. This is preferably achieved by the insertion of a connector position assurance (CPA) member, which can only be fully inserted into the plug connector upon correct coupling of the plug connector and which mechanically separates the contact between the contact surfaces upon full insertion.

Preferably, the contact surfaces do not contact any structure of the separator device when the plug connector is correctly coupled to a corresponding counter-connector. Since being out of contact with any structure of plug connector, the contact surfaces are less prone to fogging. Fogging means the unintended deposition of material, such as plastic material from a member that is in contact with the contact surfaces. This member can for example be a separator device that is e.g. part of the CPA member or a corresponding retainer.

Preferably, the separator device contacts the actuating surface(s) when the plug connector is correctly coupled to a corresponding counter-connector. A contact between the actuating surfaces and the plug connector is advantageous, since the fogging or the deposition of residual layers will occur mainly in these areas, where the shorting tongues are in contact with the separator device, i.e. on the actuating surface(s). Since the actuating surfaces do not contribute to the electrical contact between the shorting tongues, fogging and/or other deposition of residual layers on the actuating surface(s) does not influence the electrical contact between the contact surfaces. Thus, the electrical contact can be maintained under high conductivity values over the lifespan of the plug connector. In particular, even after several plugging operations, the electrical contact provides a high quality, such as high conductivity values.

Preferably, the separator device is at least partly arranged between the contact surfaces without contacting any one of the contact surfaces when the plug connector is correctly coupled through a corresponding counter-connector. A partly arrangement of the separator device between the contact surfaces prevents the contact surfaces from contacting each other due to environmental influences, such as shocks and/or vibrations. For example, if a vehicle is involved in a crash, high deceleration values occur. These deceleration values might lead to an unintentional contact of the shorting tongues, so that the safety restraint system cannot work properly.

Preferably, at least one terminal and a respective shorting tongue of the shorting clip are integrally formed as one part, wherein preferably each of the at least two terminals and the respective shorting tongue of the shorting clip are integrally formed as one part. By integrally forming the terminal and the respective shorting tongue, manufacturing costs can be reduced and the number of parts to be handled during the assembly of the plug connector can be reduced. Thus, costs can be effectively minimized.

Preferably, the actuating member of the shorting tongue is formed by a metal forming such as embossing, bending and or punching. These metal forming techniques are well known in the art and provide cost-efficient manufacturing methods. Therefore, the overall costs of the terminal and the shorting clip can be reduced. Preferably, at least one terminal and at least one shorting tongue of the shorting clip includes copper or copper based alloy. The copper based shorting tongue allows good conductive properties and a suitable flexibility of the tongues. Thus, high contact forces can be achieved.

Preferably, the contact surfaces are not gold plated. Due to the geometry of the shorting tongues, a plating, such as gold plating, is no longer necessary since the shorting tongues are provided with contact surfaces and actuating surface(s). Thus, the contact surfaces are less prone to the deposition of residual layers.

A method of assembling an electrical connector assembly is also provided. The method includes the steps of providing a plug connector as described above, providing a corresponding counter-connector and mating the plug connector with the corresponding counter-connector when the contact between the at least two contact surfaces is separated upon correct coupling of the plug connector to the corresponding counter-connector. The separation of the contact between the at least two contact surfaces allows the electrical or electronic monitoring of the plug condition. If the connector is mated correctly, the terminals are no longer short circuited, so that on the one hand the monitoring is possible and on the second hand, the safety restraint system is unlocked, since the pins of the restraint system, as described before are no longer shorted via the terminals and the shorting clip.

Preferably, the method further includes the steps of providing a connector position assurance (CPA) member, wherein the CPA member is provided with a separator device, and inserting the CPA member into a housing of the plug connector, so that the separator device interacts with the actuating surface of the actuating member in order to separate the contact between the at least two contact surfaces upon full insertion of the CPA member into housing of the plug connector. Providing a connector position assurance member allows the manual separation of the contact between the at least two contact surfaces. The CPA member therefore is inserted into the housing after the plug connector is plugged to the corresponding counter-connector. This can preferably be achieved in one plugging movement. However, the insertion of the CPA member is only possible when the plug connector is mated correctly. Thereby, a separator device separates the contact between the contact surfaces.

Preferably the method further includes the steps of separating the contact between the at least two contact surfaces of the shorting clip upon correct coupling of the plug connector to a corresponding counter-connector, wherein the corresponding counter-connector includes a separator device, which separator device interacts with the actuating surface of the actuating member so that the contact between the at least two contact surfaces is separated upon correct coupling of the plug connector to the corresponding counter-connector. If the separator device is provided within the counter-connector, such as a retainer, the separation of the contact between the contact surfaces can be achieved automatically. Thus no further manual insertion of an additional member, such as a CPA member, is necessary.

An electrical connector system including a plug connector and a corresponding counter-connector, wherein the plug connector includes a shorting clip according to the previous description is further provided. This electrical connector system allows the monitoring of the correct coupled condition of the corresponding counter-connector and the plug connector and further the short circuiting of the terminals of the plug connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1A:
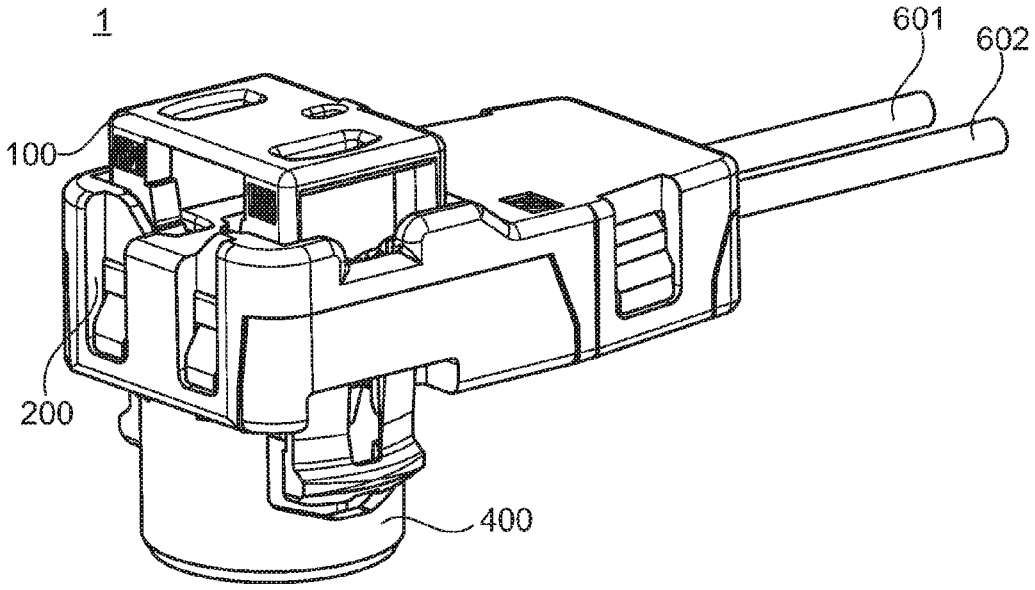
FIG. 1A shows a schematic illustration of a plug connector according to one embodiment.

FIG. 1A shows a non-limiting example of an electrical plug connector 1, including a first housing member 200 and a second housing member 400. The electrical plug connector further includes two signal lines 601, 602. The CPA member 100 can be inserted into the first and second housing members 200, 400 of the plug connector 1 when the plug connector 1 is correctly coupled to a corresponding counter-connector (not shown).

Figure 1B:
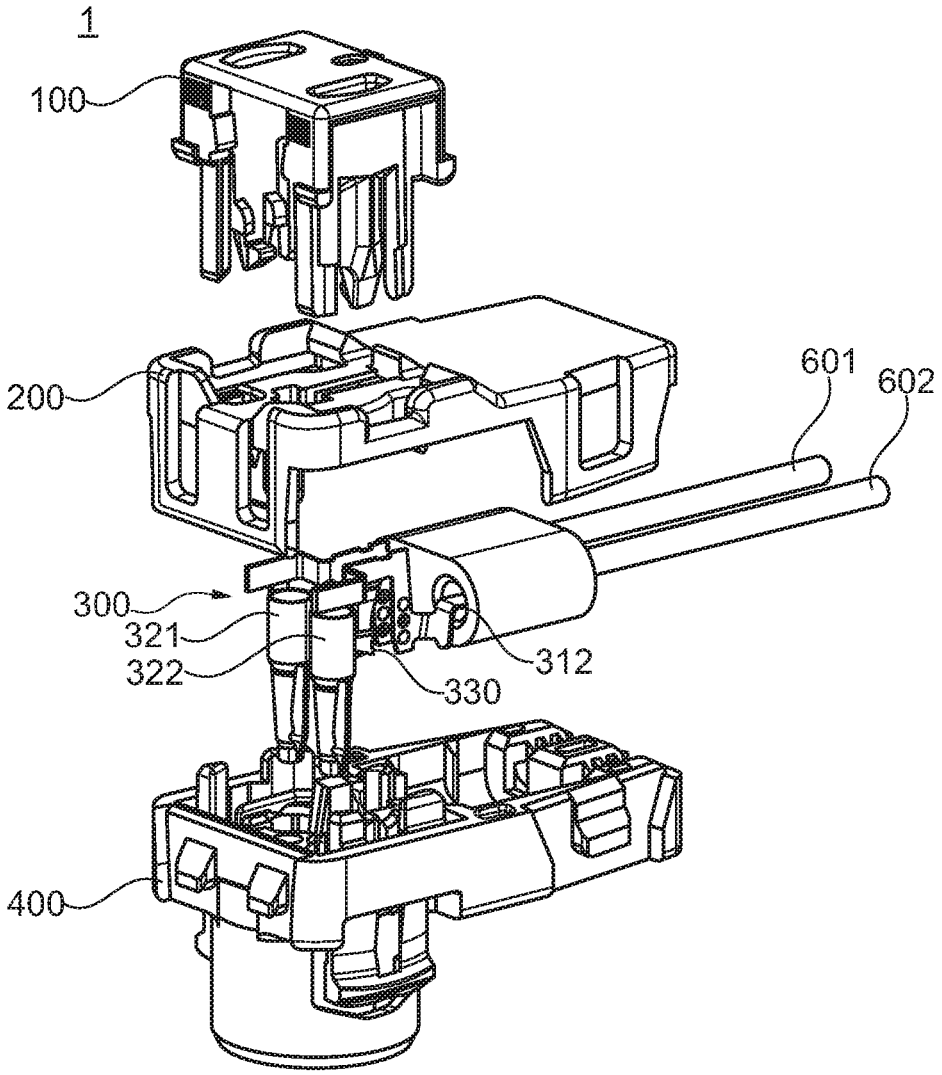
FIG. 1B shows an exploded view of the plug connector of FIG. 1A according to one embodiment.

FIG. 1B shows the connector of FIG. 1A in an exploded view. The terminal assembly 300 is enclosed by the first and second housing members 200, 400 and includes at least two terminals 321, 322. Further, the terminal assembly 300 includes a shorting clip 330 and welding or soldering pads 311, 312, to connect the signal lines 601, 602 to the terminal 321, 322.

Figure 2A:
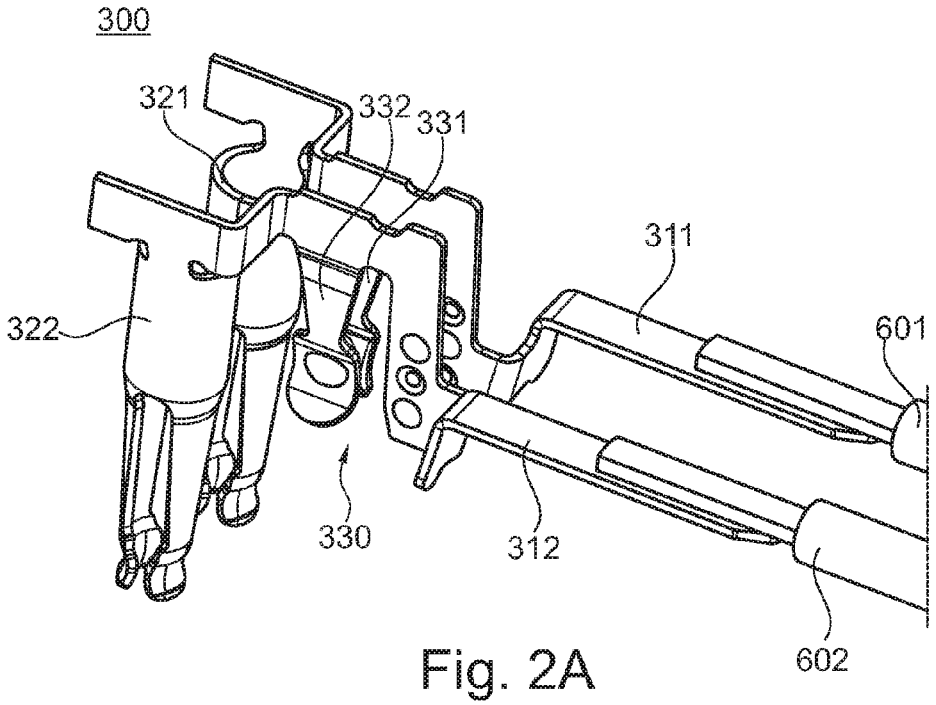
FIGS. 2A and 2B show a schematic illustration of a terminal assembly according to one embodiment.
Figure 2B:
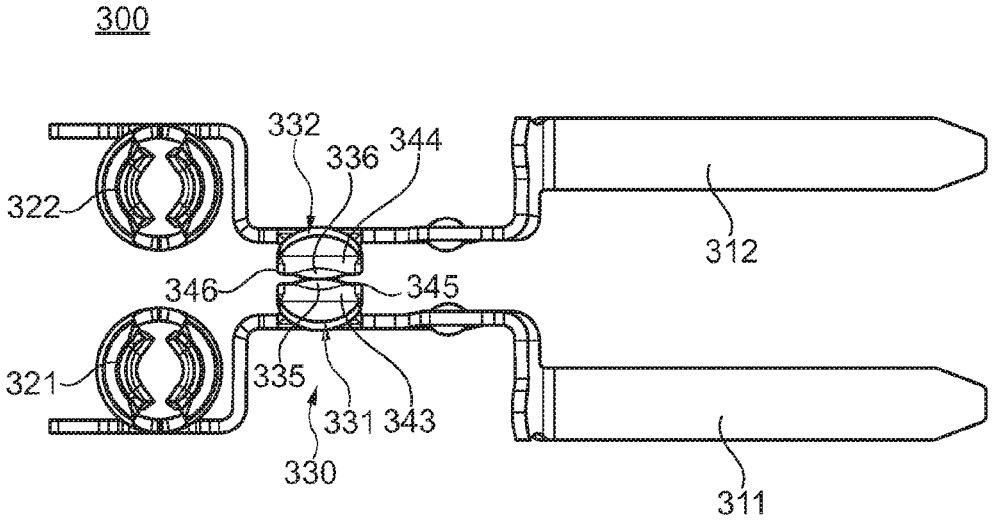

FIGS. 2A and 2B show the terminal assembly 300 from different perspectives. The terminal assembly 300 includes terminals 321 and 322, which are electrically connected to a respective one of the shorting tongues 331, 332 of the shorting clip 330. Further, the welding or soldering pads 311, 312 are electrically connected to the terminals 321, 322. Preferably, the terminals 321, 322, the shorting tongues 331, 332 and the welding/soldering pads 311, 312 are integrally formed as one part. The welding or soldering pads 311, 312 are configured to be soldered to respective signal lines 601, 602. Other connection techniques such as welding or the like are also suitable.

Further, as best can be seen in FIG. 2B, each of the shorting tongues 331, 332 includes at least one electrical contact surface 335, 336 and a recessed actuating member 343, 444, having an actuating surface 345, 446. The contact surfaces 335, 336 can for example be manufactured by embossing or the like. The actuating surface(s) is/are configured to contact a separator device in order to bend the shorting tongues or at least one of the shorting tongues 331, 332 outwardly so that the contact between the contact surfaces 335, 336 is open.

Figure 3A:
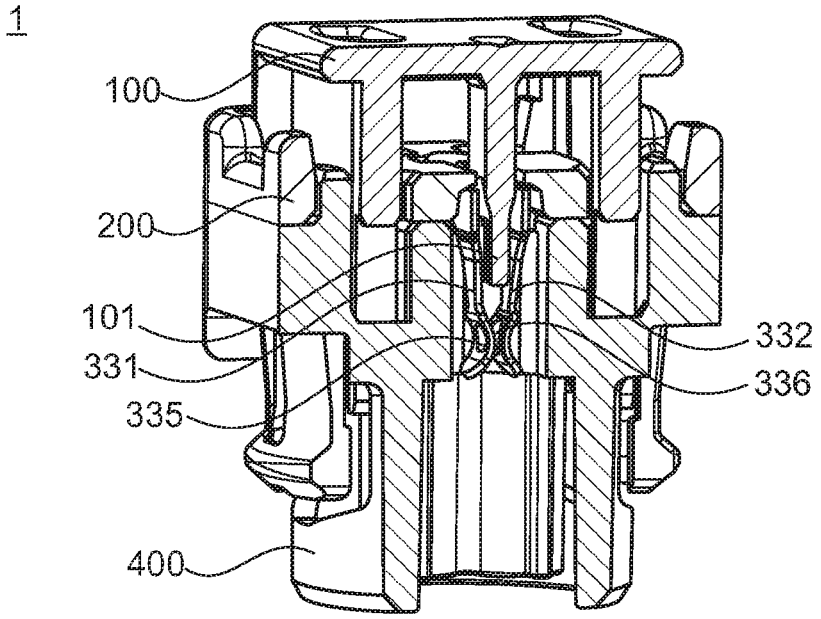
FIGS. 3A and 3B show a schematic cut view of an electrical plug connector in an uncoupled and a coupled condition according to one embodiment.

FIG. 3A shows an electrical plug connector 1 in a cut view, wherein the electrical plug connector 1 is in an uncoupled condition. The first and second housing members 200, 400 enclose the terminal assembly 300 at least partly, wherein the shorting tongues 331, 332 are received within the first and second housing members 200, 400. The CPA member 100 is not yet fully inserted into the first and second housing members 200, 400. Further, the separator device 101 is positioned between the shorting tongue 331, 332, but does not bend the shorting tongues 331, 332 outwardly, i.e. the electrical contact between contact surfaces 335, 336 is still established.

Figure 3B:
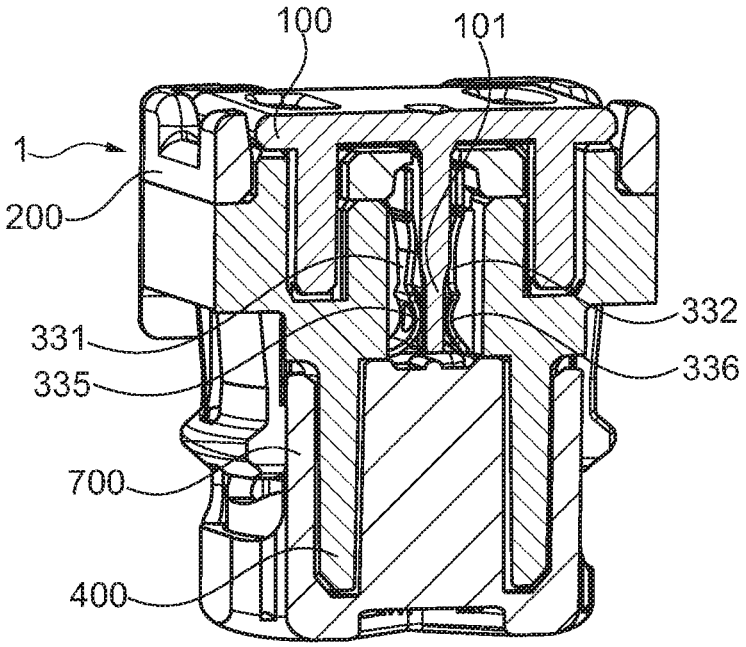

FIG. 3B, shows the electrical plug connector 1 in a correctly coupled condition and a corresponding counter-connector 700. In the correctly coupled condition, the contact between the contact surfaces 335, 336 is separated by the separator device 101 of the CPA member 100. Preferably, the separator device 101 bends at least one of the shorting tongues 331, 332 outwardly, to open the contact between the contact surfaces 335, 336. Since the CPA member 100 can only be inserted when the plug connector 1 is correctly coupled to the corresponding counter-connector 700, and since the CPA member 100 opens the contact between the contact surfaces 335, 336 upon being inserted into the first and second housing members 200, 400, the correct coupling of the electrical plug connector 1 to a corresponding counter-connector 700 can be monitored electrical or electronically.

Figure 3C:
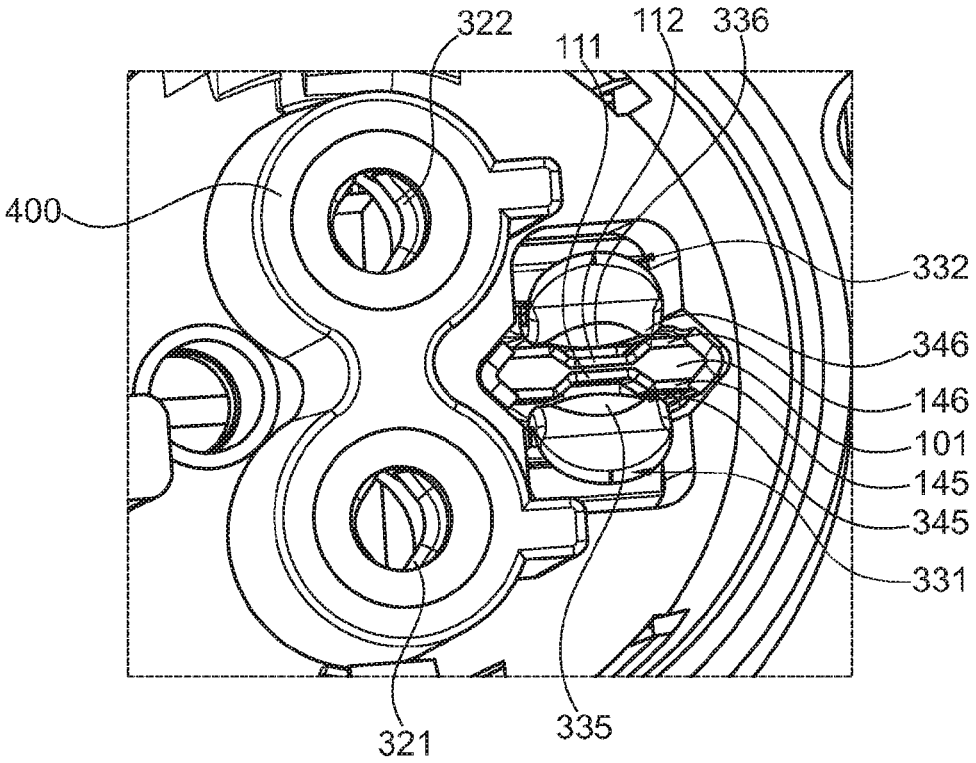
FIG. 3C shows a detailed view of the electrical plug connector in a coupled condition according to one embodiment.

FIG. 3C shows a detailed view of the separator device 101, being positioned between the shorting tongues 331, 332 and in particular between the contact surfaces 335, 336. As can be seen, the contact surfaces 335, 336 protrude from the shorting tongue 331, 332 since they are for example manufactured by embossing. Thus, the contact surfaces 335, 336 and the actuating surfaces 346, 345 are not arranged within the same plane. The plane of a surface is defined by the surface itself if the surface is a flat surface. In the case that the surface is a curved surface that is for example achieved by bending or by embossing a metal sheet, the plane that is associated with the curved surface is the tangential surface in the contact point. The contact point has to be understood as the point, in which the shorting tongues 332, 331 contact each other or respectively, the point, in which the separator device 101 contacts the actuating surface 346, 345.

As shown in FIG. 3C, the separator device 101 is provided with at least two recesses 111, 112. These recesses are designed such that the contact surfaces 335, 336 of the shorting tongue 331, 332 do not contact the separator device 101 when the plug connector 1 is correctly coupled to a corresponding counter-connector 700. The separator device 101 preferably further includes corresponding actuating surfaces 145, 146, that are configured to interact with the actuating surface(s) 345, 346 of the shorting tongues 331, 332. The interaction between the actuating surfaces and the corresponding actuating surfaces is at least a mechanical contact and even more preferred this mechanical contact results in a bending of the shorting tongues or at least one shorting tongue 331, 332. Preferably, the separator device 101 includes a plastic material.

By separating the actuating surface and the contact surface of the shorting tongues 331, 332, the undesired deposition of residual layers of plastic and/or the like due to fogging can be significantly reduced. Thus, the electrical conductivity properties of the contact between the contact surfaces can be maintained stable during the use of the electrical plug connector 1.

Figure 4A:
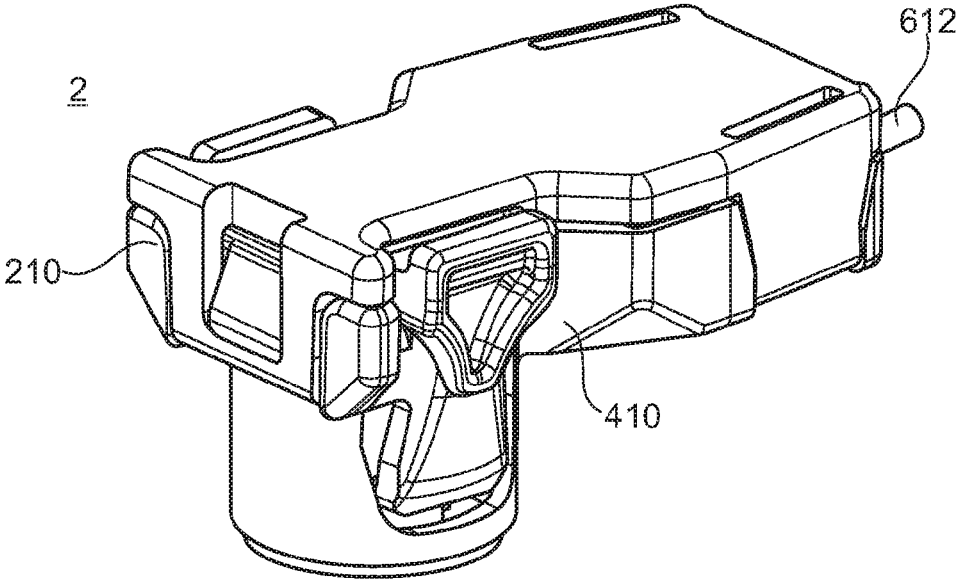
FIG. 4A shows a schematic illustration of a further embodiment of an electrical plug connector according to one embodiment.
Figure 4B:
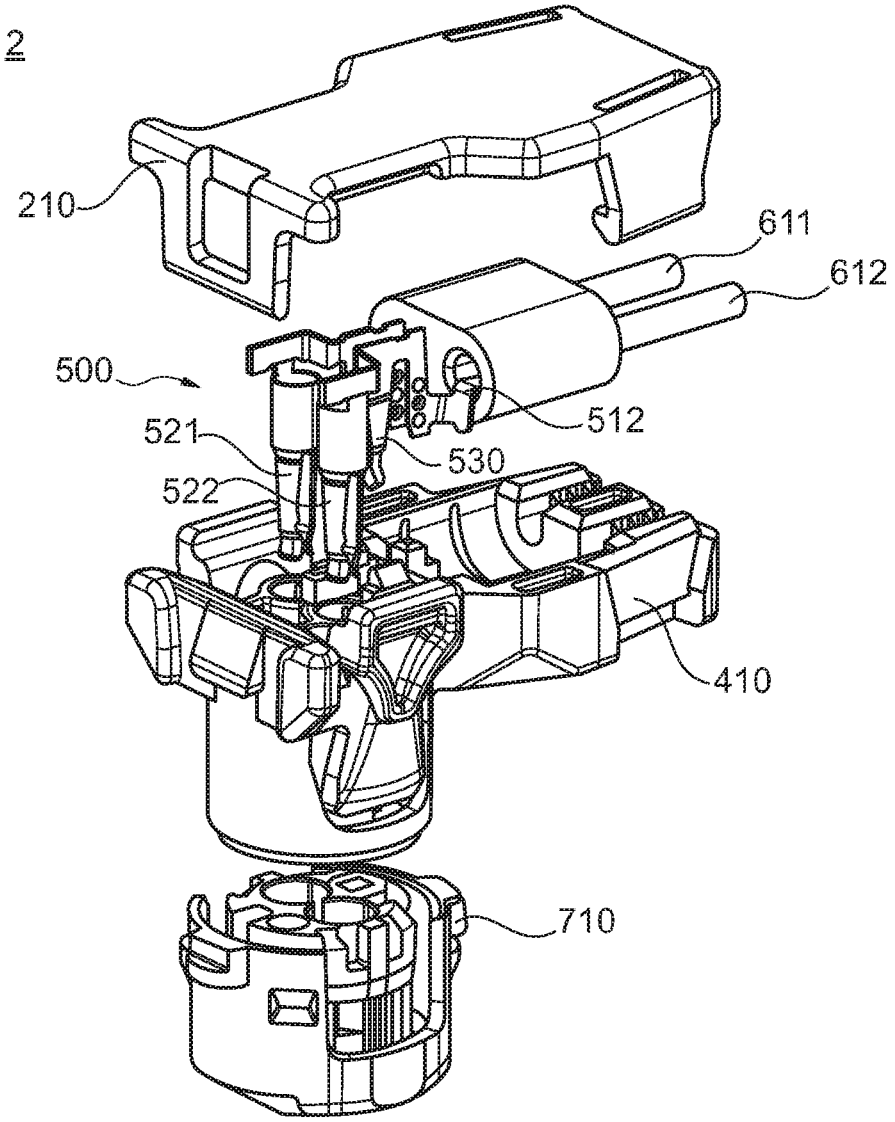
FIG. 4B shows the electrical plug connector of FIG. 4A in an exploded view according to one embodiment.

FIG. 4A shows an electrical plug connector 2. The electrical plug connector 2 includes a first housing member 210 and a second housing member 410 that form the housing of the plug connector 2. Further, the electrical plug connector 2 includes at least one signal line 612. FIG. 4B shows the electrical plug connector 2 in an exploded view. As can be seen, the first and second housing members 210, 410 of the electrical plug connector 2 receive a terminal assembly 500 that includes at least two terminal 521, 522. The terminal assembly 500 further includes a shorting clip 530 and welding or soldering pads 511, 512 for welding or soldering the signal lines 611, 612. Further, the electrical plug connector 2 can be coupled to a corresponding counter-connector 710.

Figure 5A:
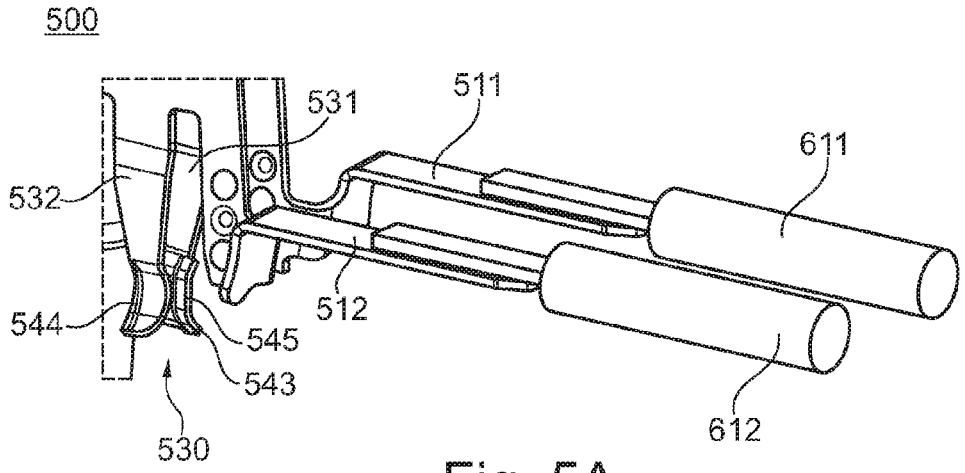
FIGS. 5A and 5B show a schematic illustration of the terminal assembly of the plug connector according to one embodiment.
Figure 5B:
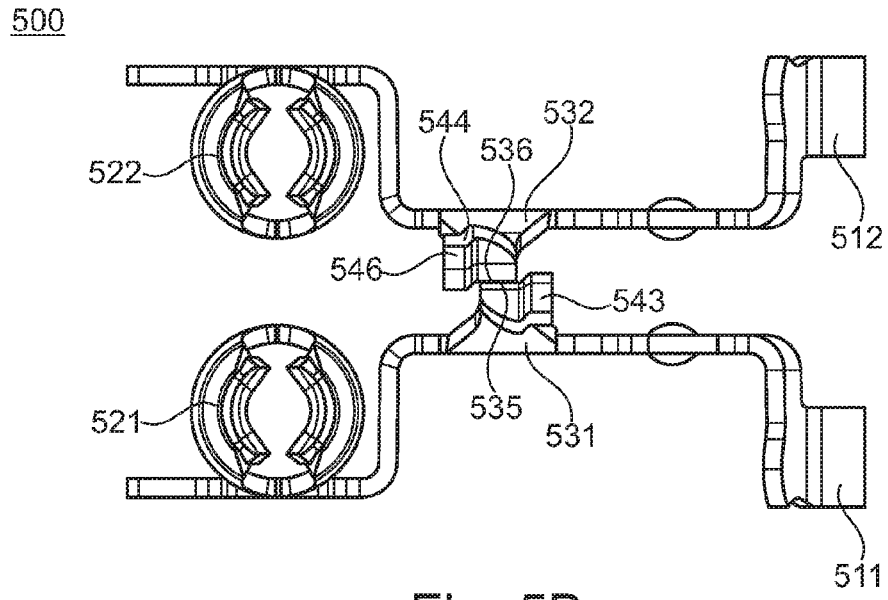

FIG. 5A shows a detailed view of the terminal assembly 500 of the electrical plug connector 2, shown in FIG. 4B. The terminal assembly 500 includes a shorting clip 530, wherein the shorting clip 530 includes at least two shorting tongues 531, 532, which are configured to short circuit the at least two contact terminals (not shown). A terminal, a respective shorting tongue and a respective welding or soldering pad 512 are electrically connected to each other and preferably integrally formed as a single part. Each of the welding or soldering pads 512, 511 is configured to be soldered to a respective signal line 611, 612. Other connection techniques, such as welding and the like, are also suitable. The shorting tongues 532, 531 include at least one electrical contact surface 535, 536 as best can be seen in FIG. 5B, further, the shorting tongues 532, 531 shown here, include an actuating member 344, 343, wherein each actuating member 344, 343 includes an actuating surface 545, 546. The actuating surface 545, 546 is configured to interact with a separator device (not shown). The contact surfaces 335, 336 are configured to contact each other if the plug connector 2 is in an uncoupled or in an incorrectly coupled condition. As shown in FIG. 5B, the contact surfaces 535, 536 and the corresponding actuating surfaces 546, 545 of the corresponding actuating members 543, 544 are arranged in different planes. A plane has to be understood, as defined within the description of FIG. 3C.

Since the surfaces are not arranged within the same plane, the surfaces are separated from each other. Therefore, as shown in FIGS. 6B and 6D, just the actuating surfaces 545, 546 are configured to contact a separator device 711, so that the contact surfaces 535, 536 do not contact the separator device 711. Therefore, fogging and/or other deposition of residual layers can be prevented. The actuator members 543, 544 are preferably formed by embossing, bending and/or punching processes.

Figure 6A:
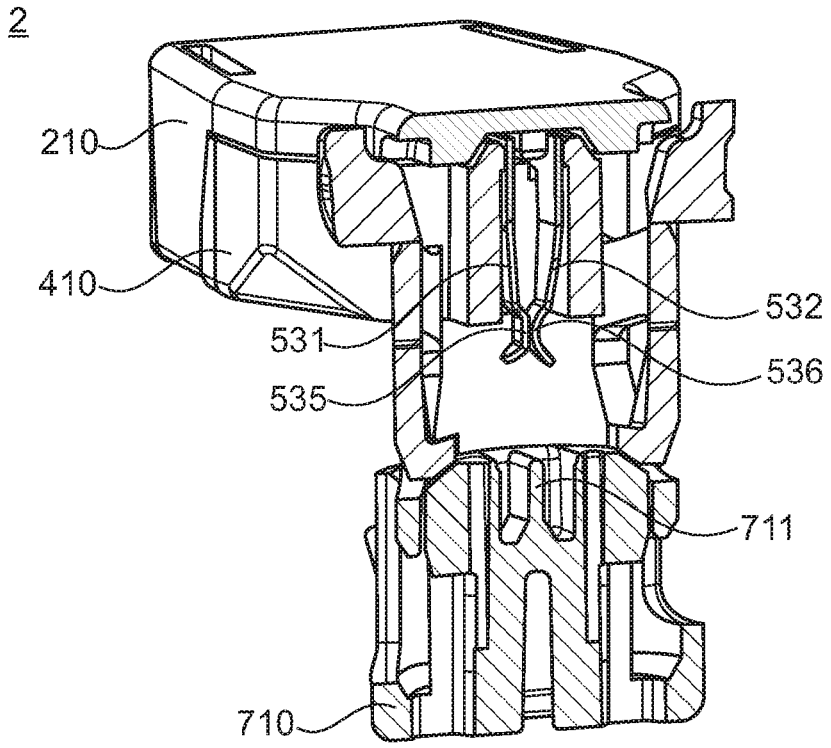
FIGS. 6A and 6B show a schematic illustration of the electrical plug connector of FIG. 4A in an uncoupled condition according to one embodiment.
Figure 6B:
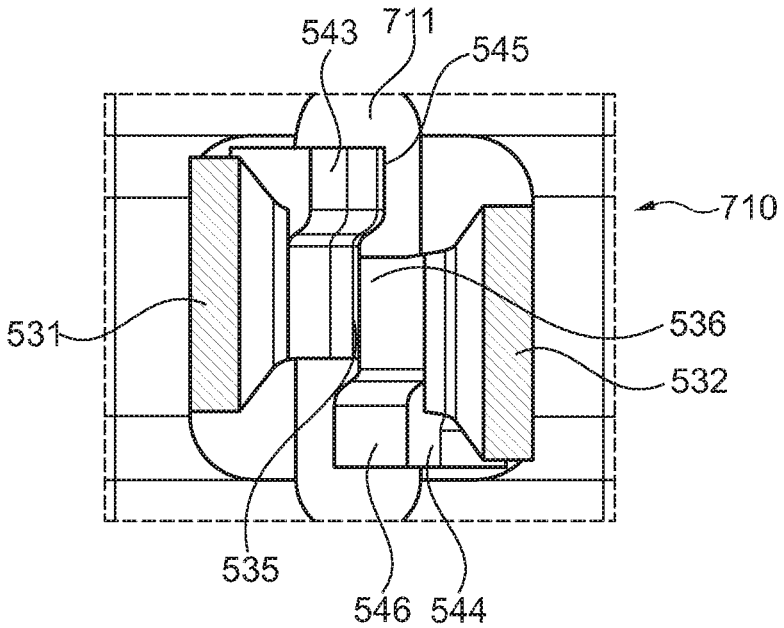

FIG. 6A shows the electrical plug connector 2 and a corresponding counter-connector 710 in a cut view. The first and second housing members 210, 410 of the plug connector 2 enclose the shorting tongues 531, 532. As can be seen, the contact surfaces 535, 536 of the shorting tongues 531, 532 are in contact with each other when the plug connector 2 is in the uncoupled or incorrectly coupled condition. The counter-connector 710 includes a separator device 711 that is preferably formed from plastic or includes at least a plastic material. The separator device 711 is configured to be forced between the shorting tongues 531, 532, in order to open the contact between the contact surfaces 535, 536. Further, at least one of the shorting tongues 531, 532 is bent outwardly by the separator device 711.

FIG. 6B shows a detailed cut view of the electrical plug connector 2 as shown in FIG. 6A, wherein the cut is performed along the line A-A. As can be seen, the contact surfaces 535, 536 of the shorting tongues 531, 532 contact each other, so that the terminals of the plug connector 2 are short circuited. Further, the shorting tongues 531, 532 include actuating members 543, 545, having each an actuating surface 545, 546. These actuating surfaces 545, 546 are configured to be contacted by the separator device 711, so that at least one of the shorting tongues 531, 532 is bent outwardly in order to open the contact between the contact surfaces 535, 536. The actuating surfaces 545, 546 and the contact surfaces 535, 536 of one shorting tongue are arranged in different planes. Therefore, these surfaces are separate from each other. Thus, when separating the contact between the contact surfaces 535, 536 by means of the separator device 711, the contact surfaces 535, 536 will not contact the separator device 711.

Figure 6C:
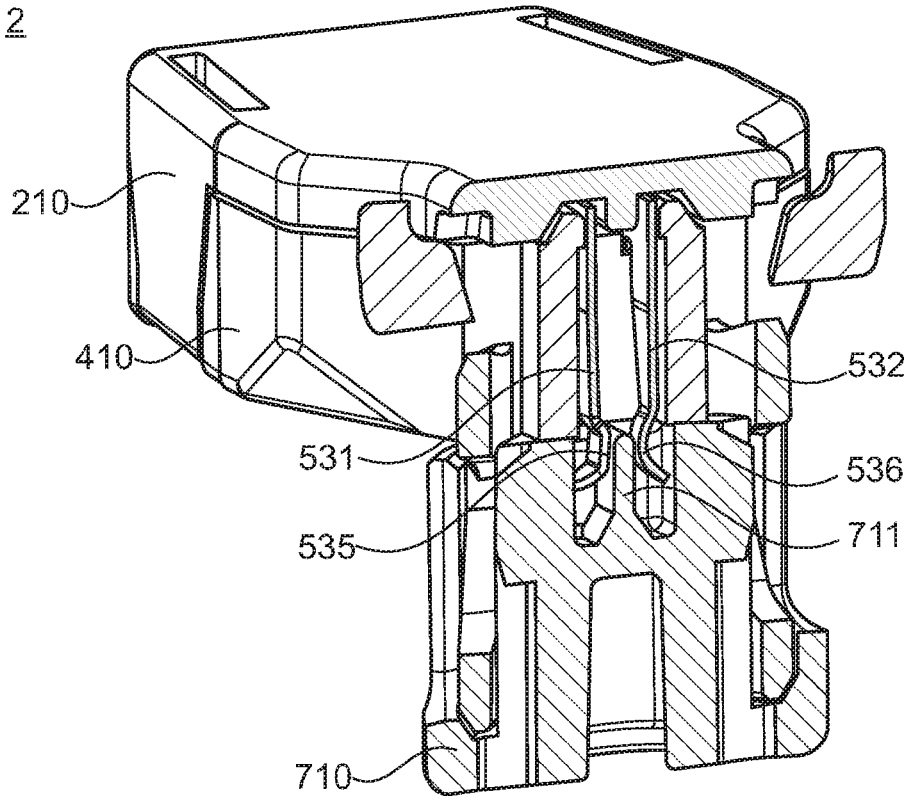
FIGS. 6C and 6D show a schematic illustration of the electrical plug connector of FIG. 4A in a coupled condition according to one embodiment.
Figure 6D:
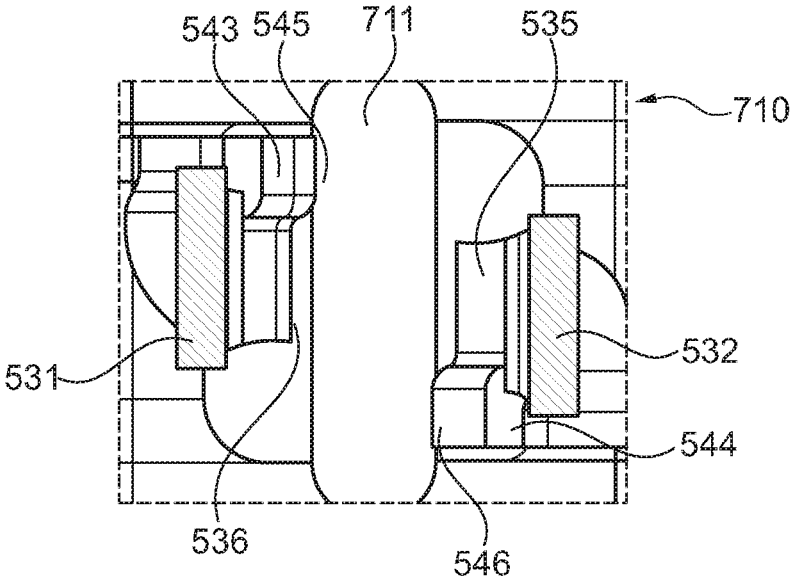

Further, FIG. 6C shows the plug connector 2 in a correctly coupled condition. In the electrical coupled condition, the contact between the contact surfaces 535, 536 of the shorting tongues 531, 532 is separated by the separator device 711. In this condition, the separator device 711 is forced between the actuating surfaces 545, 546 as shown in FIG. 6D. FIG. 6D is a partial cut view of the electrical plug connector 2 of FIG. 6C, wherein the view is cut along the line B-B. The separator device 711 is forced between the shorting tongues 531, 532 and interacts with the actuating surfaces 545, 546 of the actuating members 543, 544. Since the actuating surfaces 545, 546 are arranged in a different plane than the corresponding contact surfaces 535, 536, the contact surfaces 535, 536 will not contact the separator device 711. Thus, fogging can be prevented and the electrical connection properties of the contact surfaces 535, 536 can be maintained.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical plug connector, comprising:

a plug connector;

at least two contact terminals within the plug connector; and a shorting clip configured to short circuit the at least two contact terminals when the plug connector is in an uncoupled or incorrectly coupled condition, wherein the shorting clip further includes at least two shorting tongues, wherein each shorting tongue is electrically connected with a respective one of the at least two contact terminals, wherein each shorting tongue further includes an electrical contact surface, wherein the electrical contact surfaces contact each other to short circuit the at least two contact terminals when the plug connector is in an uncoupled or incorrectly coupled condition, wherein at least one of the shorting tongues includes an actuating member, wherein the actuating member is provided with an actuating surface that is configured to interact with a separator device, when the plug connector is in an correctly coupled condition, and wherein the electrical contact surfaces are embossed projections that protrude from the actuating surfaces and are not arranged within the same planes as the actuating surfaces.

2. The electrical plug connector according to claim 1, wherein at least one of the two shorting tongues includes a bendable portion, wherein the bendable portion is bent to open a contact between the at least two contact surfaces upon correct coupling of the plug connector.

3. The electrical plug connector according to claim 1, further comprising a housing and a connector position assurance (CPA) member, which is insertable into the housing of the plug connector and which the CPA member includes a separator device, which separator device interacts with the actuating surface of the actuating member during insertion of the CPA member into the housing of the plug connector, so that electrical contact between the at least two contact surfaces is opened.

4. The electrical plug connector according to claim 1, wherein electrical contact between the at least two contact surfaces is configured to be opened upon correct coupling the electrical plug connector to a corresponding counter-connector, wherein the corresponding counter-connector includes a separator device, which separator device interacts with the actuating surface of the actuating member during correct coupling of the plug connector to the corresponding counter-connector, so that the electrical contact between the at least two contact surfaces is opened.

5. The electrical plug connector according to claim 1, wherein the electrical contact surface does not contact any structure of the separator device when the plug connector is correctly coupled to a corresponding counter-connector.

6. The electrical plug connector according to claim 1, wherein the separator device contacts the actuating surface when the plug connector is correctly coupled to a corresponding counter-connector.

7. The electrical plug connector according to claim 1, wherein the separator device is at least partly arranged between the at least two contact surfaces without contacting any one of the at least two contact surfaces when the plug connector is correctly coupled to a corresponding counter-connector.

8. The electrical plug connector according to claim 1, wherein at least one terminal and one respective shorting tongue of the shorting clip are integrally formed, and wherein preferably each of the at least two contact terminals and the respective shorting tongue of the shorting clip are integrally formed.

9. The electrical plug connector according to claim 1, wherein the actuating member of the shorting tongue is formed by a metal forming process.

10. The electrical plug connector according to claim 1, wherein at least one terminal and at least one shorting tongue of the shorting clip include copper or a copper based alloy.

11. The electrical plug connector according to claim 1, wherein the at least two contact surfaces are not gold plated.

12. A method for assembling an electrical connector assembly comprising the steps of:

providing a plug connector having at least two contact terminals within the plug connector and a shorting clip configured to short circuit the at least two contact terminals when the plug connector is in an uncoupled or incorrectly coupled condition, wherein the shorting clip further includes at least two shorting tongues, wherein each shorting tongue is electrically connected with a respective one of the at least two contact terminals, wherein each shorting tongue further includes at least one electrical contact surface, wherein the electrical contact surfaces contact each other to short circuit the at least two contact terminals when the plug connector is in an uncoupled or incorrectly coupled condition, wherein at least one of the shorting tongues includes an actuating member, wherein the actuating member is provided with an actuating surface that is configured to interact with a separator device, when the plug connector is in an correctly coupled condition, and wherein the at least two contact surfaces are embossed projections that protrude from the actuating surfaces and are not arranged within the same planes as the actuating surfaces;

providing a corresponding counter-connector; and mating the plug connector with the corresponding counter-connector, wherein a contact between the at least two contact surfaces is separated upon correct coupling the plug connector to the corresponding counter-connector.

13. The method according to claim 12, comprising further the steps of:

providing a connector position assurance (CPA) member, wherein the CPA member is provided with a separator device, and inserting the CPA member into a housing of the plug connector so that the separator device interacts with the actuating surface of the actuating member in order to separate the contact between the at least two contact surfaces upon full insertion of the CPA member into the housing of the plug connector.

14. The method according to claim 12, comprising further the steps of:

separating the contact between the at least two contact surfaces of the shorting clip upon correct coupling the plug connector to the corresponding counter-connector, wherein the corresponding counter-connector includes a separator device, which separator device interacts with the actuating surface of the actuating member, so that the contact between the at least two contact surfaces is separated upon correct coupling of the plug connector to the corresponding counter-connector.

15. An electrical connector system, comprising:

a plug connector; and a corresponding counter-connector, wherein the plug connector includes a shorting clip having at least two shorting tongues, wherein each shorting tongue is electrically connected with a respective one of the at least two contact terminals, wherein each shorting tongue further includes at least one electrical contact surface, wherein the electrical contact surfaces contact each other to short circuit the at least two contact terminals when the plug connector is in an uncoupled or incorrectly coupled condition, wherein at least one of the shorting tongues includes an actuating member, wherein the actuating member is provided with an actuating surface that is configured to interact with a separator device, when the plug connector is in an correctly coupled condition, and wherein the at least two contact surfaces are embossed projections that protrude from the actuating surfaces and are not arranged within the same planes as the actuating surfaces.

* * * * *